US006628265B2

(12) United States Patent
Hwang

(10) Patent No.: US 6,628,265 B2
(45) Date of Patent: Sep. 30, 2003

(54) PROGRAM DRIVE DEVICE FOR COMPUTERS

(75) Inventor: Bok Ha Hwang, Inchon (KR)

(73) Assignee: BestSoft Co., Ltd., Gyunggi-do (KR)

( * ) Notice: Subject to any disclaimer, the term of this patent is extended or adjusted under 35 U.S.C. 154(b) by 353 days.

(21) Appl. No.: 09/766,667

(22) Filed: Jan. 23, 2001

(65) Prior Publication Data

US 2001/0022574 A1 Sep. 20, 2001

(30) Foreign Application Priority Data

Jan. 24, 2000 (KR) ..... 2000-03142

(51) Int. Cl.[7] ..... G09G 5/00

(52) U.S. Cl. ..... 345/156; 345/175; 250/221; 434/250

(58) Field of Search ..... 345/156, 157, 345/173, 175; 250/221, 222.1; 434/247, 250, 307 A; 463/7; 273/441, 244

(56) References Cited

U.S. PATENT DOCUMENTS 5,017,770 A * 5/1991 Sigalov ..... 250/221
5,081,896 A * 1/1992 Hiyoshi et al. ..... 84/600
5,442,168 A * 8/1995 Gurner et al. ..... 463/36
6,476,812 B1 * 11/2002 Yoshigahara et al. ..... 345/427
6,492,775 B2 * 12/2002 Klotz et al. ..... 315/120

FOREIGN PATENT DOCUMENTS

EP 1132888 * 12/2001
JP 06-301475 10/1994

* cited by examiner

*Primary Examiner*—Dennis-Doon Chow
(74) *Attorney, Agent, or Firm*—Jeffrey S. Melcher; Manelli Denison & Selter, PLLC

(57) ABSTRACT

A program drive device for computers and game machines, designed to run a variety of game programs, aerobic programs or dance programs on personal computers, commercial computers, personal game machines, or commercial game machines, under the control of users' physical action, is disclosed. The program drive device of this invention consists of a pad having a predetermined area and provided with a plurality of rails thereon. A support column movably engages with each of said rails while standing upright on the rail, and is movable along the rail as desired, and is fixed to the rail at an adjustable position. Upper and lower sensor units are movably installed in each of the support columns of the rails at upper and lower portions such that the sensor units are movable along each support column and are fixed to the support column at adjustable positions. In the above program drive device, the sensor units sense a motion of a user's body moving on the pad and output motion signals to a computer, thus allowing the computer to display a variable motion of a character, corresponding to the motion of the user's body, on the monitor of the computer.

7 Claims, 4 Drawing Sheets

PROGRAM DRIVE DEVICE FOR COMPUTERS

Applicant hereby claims priority of the Korean Patent Application No. 2000-0003142, filed Jan. 24, 2000, the entire disclosure of which is considered as being part of the disclosure of the accompanying application and is hereby incorporated by reference therein.

BACKGROUND OF THE INVENTION

1. Field of the Invention

The present invention relates to a program drive device for computers and game machines, designed to run a variety of game programs, aerobic programs or dance programs on personal computers, commercial computers, personal game machines, or commercial game machines, under the control of users' physical action, such as hand action and foot action, within a limited space, and, more particularly, to a program drive device for computers, having a plurality of sensor units movably installed in a plurality of support columns movably standing on a pad having a predetermined area, each of the sensor units consisting of a light emitting part and a light receiving part so as to be activated or inactivated by a motion of a user's body and outputting a motion signal to the input port of a computer, thus running a variety of game programs, aerobic programs or dance programs on personal computers, commercial computers, personal game machines, or commercial game machines, under the control of users' physical action in place of a conventional keyboard operation, joystick operation or mouse operation.

2. Description of the Prior Art

As well known to those skilled in the art, a variety of game programs, aerobic programs or dance programs for personal computers, commercial computers, personal game machines, or commercial game machines have been typically performed and controlled by operating keyboards, joysticks, or mouses.

However, such conventional game programs, aerobic programs or dance programs for computers and game machines force a user to operate a keyboard, a joystick or a mouse with his fingers while sitting in a chair and watching a monitor screen for a lengthy period of time without moving his body actively. Therefore, it is almost impossible to expect active physical exercise from use of such conventional programs. The conventional game programs, aerobic programs or dance programs for computers and game machines may adversely affect users' health when users use the programs for a lengthy period of time.

In an effort to overcome such problems experienced in the conventional game programs, aerobic programs or dance programs, somewhat active programs, such as a variety of DDR (Dance—Dance Revolution) programs, have been proposed. In order to perform a conventional DDR program, a user, standing on a control pad provided with differently oriented arrow switch sensors and laid on a flat support surface, continuously, actively and specifically steps on the arrow switch sensors of the control pad designated by quickly varying images displayed on the monitor screen. However, such conventional DDR programs only provide two-dimensional activity—in addition to jumping activity—performed by legs and feet within a limited area defined by the control pad. Therefore, the conventional DDR programs are problematic in that they cannot provide physical exercise or rhythmic movement of user's upper body, including arms and hands, even though they allow physical exercise and rhythmic movement of user's lower body including the legs and feet.

SUMMARY OF THE INVENTION

Accordingly, the present invention has been made keeping in mind the above problems occurring in the prior art, and an object of the present invention is to provide a program drive device for computers, which has a plurality of sensor units movably installed in a plurality of support columns of a pad, and consisting of a light emitting part and a light receiving part so as to be activated or inactivated by a motion of a user's body, and outputting a motion signal to the input port of a computer, thus running a variety of game programs, aerobic programs or dance programs on personal computers, commercial computers, personal game machines, or commercial game machines, under the control of users' physical action in place of a conventional keyboard operation, joystick operation or mouse operation, and which provides physical exercise and rhythmic movement of user's body while exciting user's interest.

Another object of the present invention is to provide a program drive device for computers, which is usable with a conventional DDR, thus running a program in response to a motion of hands, arms, feet and legs of a user.

A further object of the present invention is to provide a program drive device for computers, which is simply and easily connected to the input port of a conventional computer, such as the keyboard terminal, joystick terminal or mouse terminal of a personal computer, commercial computer or game machine, without forcing a user to purchase a separate equipment.

Still another object of the present invention is to provide a program drive device for computers, which is designed to run a program of a computer or a game machine in response to a motion of a user's body without forcing the user to become skilled in computer operation, thus allowing people to easily and simply use game programs of computers or game machines without being afraid of complex operation procedures of the computers and game machines.

In order to accomplish the above objects, an embodiment of the present invention provides a program drive device for running a game program in computers, comprising: a pad having a predetermined area and provided with a plurality of rails thereon; a support column movably engaging with each of the rails while standing upright on the rail, the support column being movable along the rail as desired and fixed to the rail at an adjustable position; and two sensor units movably installed in each of the support columns of the rails at upper and lower portions of the support column, thus being movable along each support column and fixed to the support column at adjustable positions, whereby the sensor units sense a motion of a user's body moving on the pad and output motion signals to a computer, thus allowing the computer to display a variable motion of a character, corresponding to the motion of the user's body, on the monitor of the computer.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
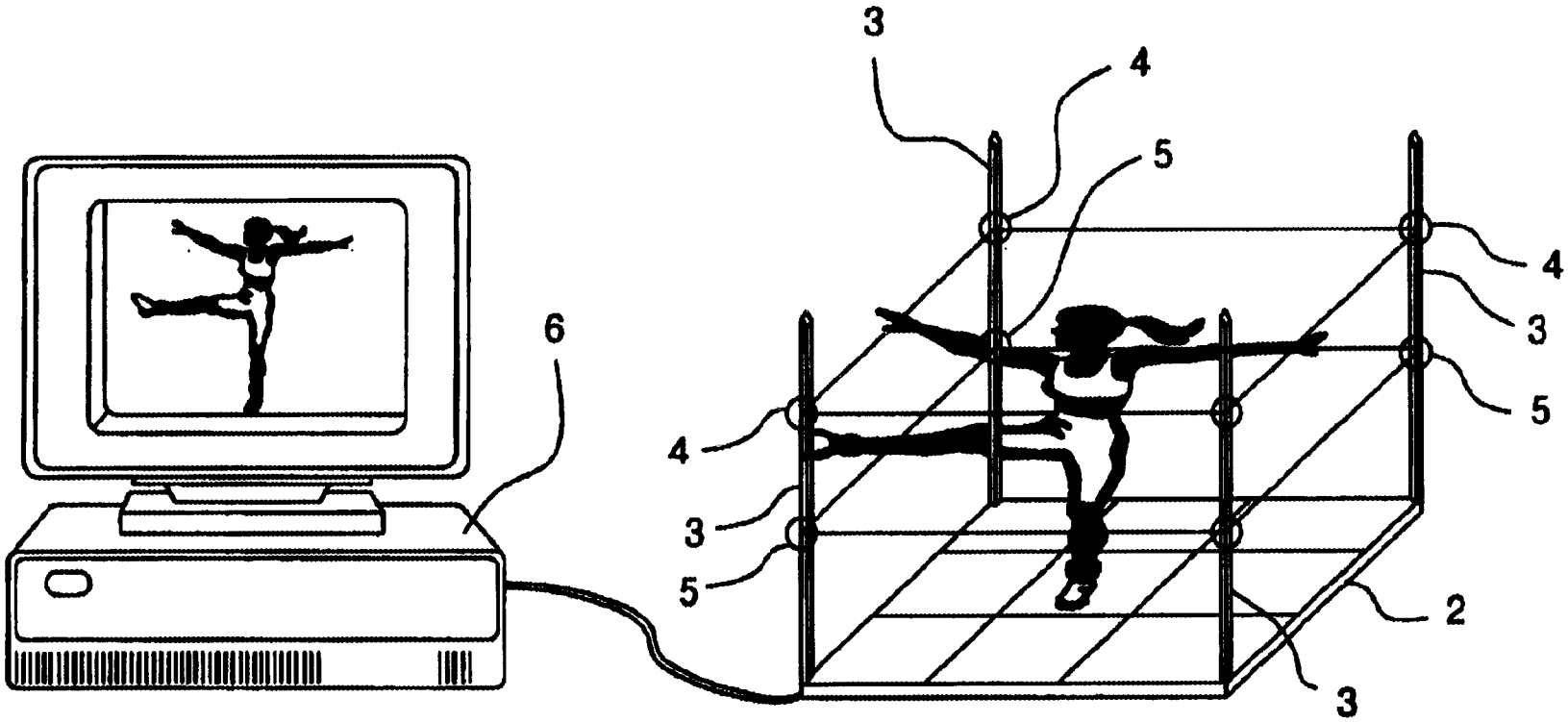
FIG. 1 is a view, showing the operational theory of a program drive device for computers in accordance with the present invention.
Figure 2:
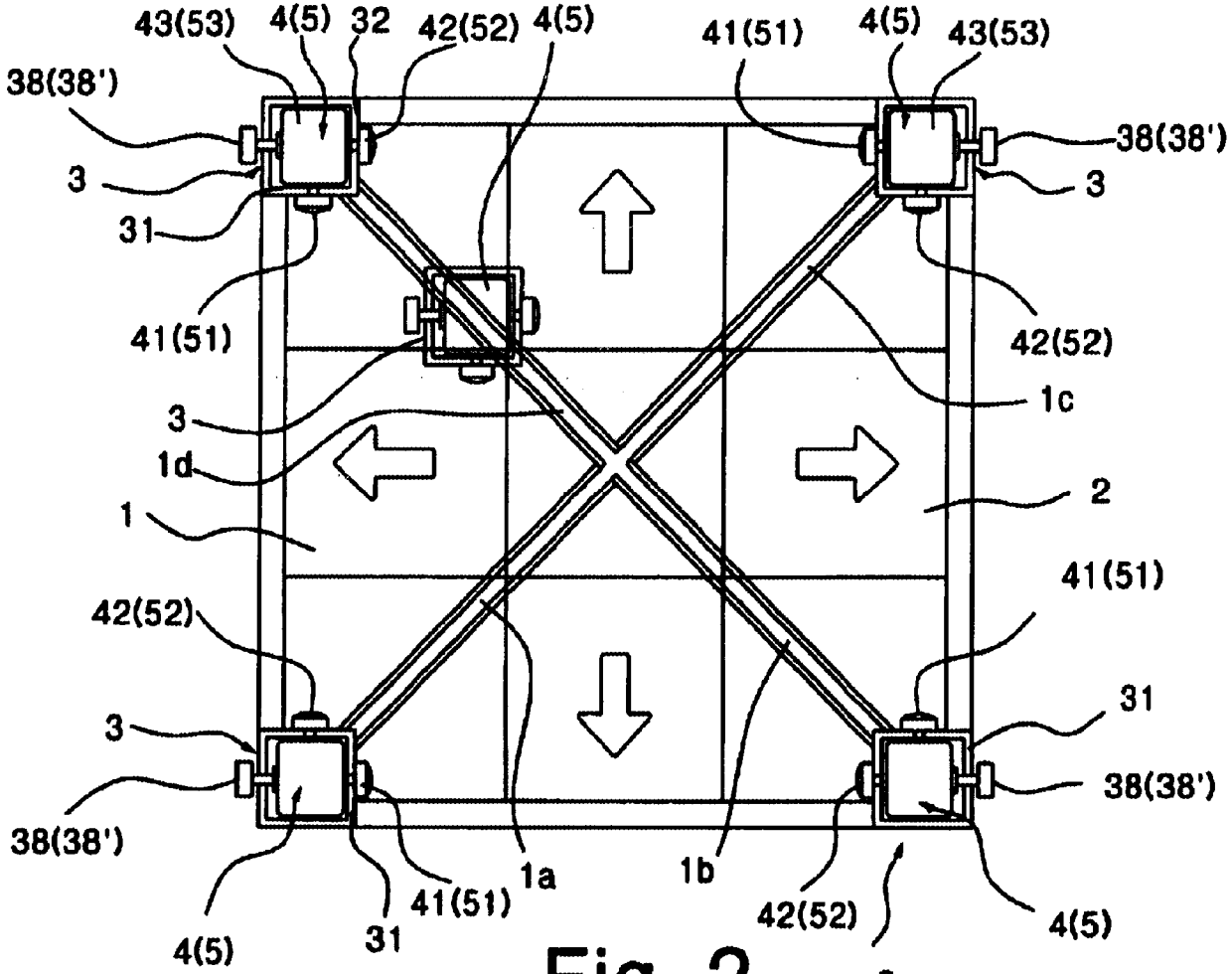
FIG. 2 is a plan view of the program drive device for computers of the present invention.
Figure 3:
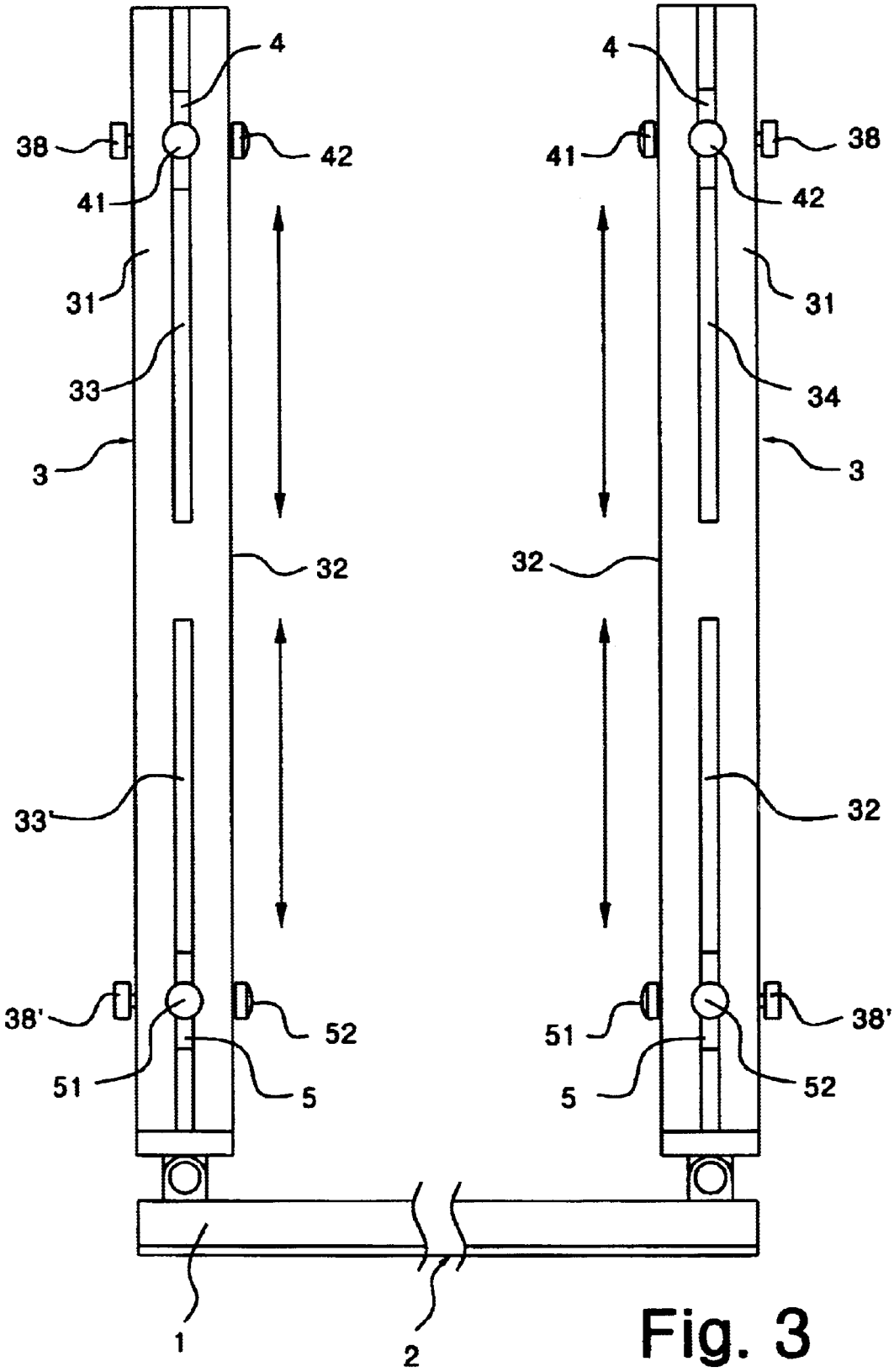
FIG. 3 is a side view of the program drive device for computers of this invention, particularly showing an opposite directional movement of sensor units relative to vertical support columns.
Figure 4:
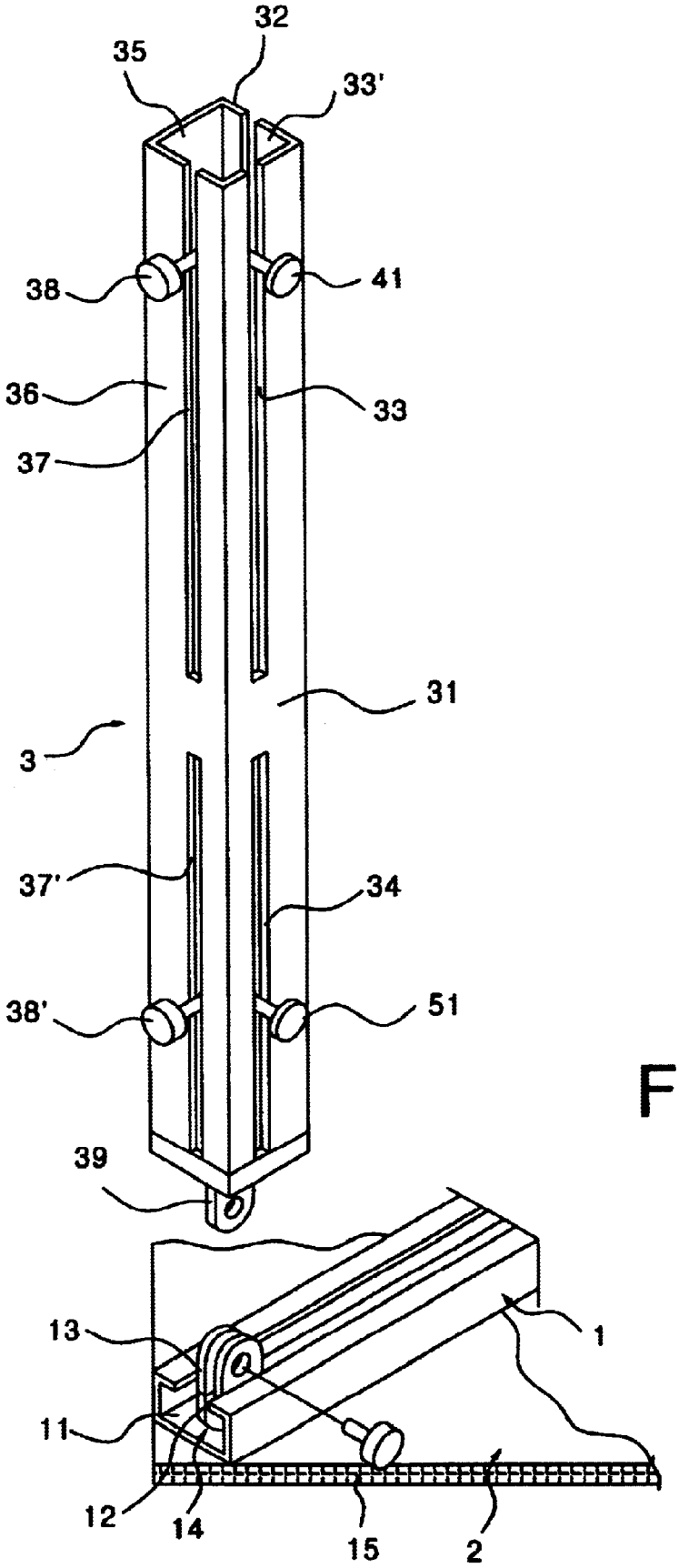
FIG. 4 is a perspective view of the program drive device for computers of this invention, particularly showing an assemblage of one support column on a control rail of the device, with an arrangement of two sensor units movably installed in the support column.

FIGS. 1 to 4 show the operational theory and construction of a program drive device for computers in accordance with the preferred embodiment of the present invention. As shown in the drawings, the program drive device of this invention comprises a rectangular pad 2 having a predetermined area and including a control rail 1 consisting of four diagonally positioned rails 1*a*, 1*b*, 1*c* and 1*d*. Four movable folding support columns 3, having a rectangular cross-section, are vertically installed at the four corners of the pad 2 such that the columns 3 are movable along the four rails 1*a*, 1*b*, 1*c* and 1*d*. Upper and lower sensor units 4 and 5 are provided at the upper and lower positions of each support column 3 such that the sensor units 4 and 5 are vertically movable in opposite directions along each support columns 3 under the guidance of vertical slits as will be described in detail later herein. Each of the upper and lower sensor units 4 and 5 comprises a light receiving part 41 or 51 and a light emitting part 42 or 52. In such a case, the light receiving parts and light emitting parts of the upper and lower sensor units 4 and 5 are selected from a variety of photo sensors, such as infrared sensors and laser sensors, and are positioned on the two inside walls 31 and 32 of each support column 3, with the two inside walls 31 and 32 meeting each other at a right angle. In the present invention, the light receiving parts and light emitting parts of the upper and lower sensor units 4 and 5 may be selected from a variety of transmissive or reflective photo sensors. The above sensor units 4 and 5 are connected to a signal input port of a computer 6, such as the keyboard terminal, joystick terminal or mouse terminal of a personal computer, a commercial computer, or a game machine, and so motion signals from the sensor units 4 and 5 are applied to the computer 6 during an operation of the program drive device.

In the above program drive device, the control rail 1, consisting of four diagonal rails 1*a*, 1*b*, 1*c* and 1*d*, has a longitudinal channel 11 formed along the rail 1. A movable connector 14 engages with the channel 11 of each of the four diagonal rails 1*a*, 1*b*, 1*c* and 1*d* such that the movable connector 14 is movable along the longitudinal channel 11. Each of the movable connectors 14 comprises a roller 12 movably set in the channel 11. A top boss 13 is formed at the top of the connector 14, and is projected upward from the channel 11. Each of the four support columns 3, having a bottom boss 39 at its lower end, is hinged to the top boss 13 of an associated movable piece 14 at the bottom boss 39 using a locking bolt 15. Therefore, the four support columns 3 movably engage with the four rails 1*a*, 1*b*, 1*c* and 1*d* of the control rail 1 while being movable along said rails and being foldable relative to the rails.

The four support columns 3 have the same shape and construction. Each of the four columns 3 is hollowed to have an axial opening 35, with two upper guide slits 33 and 33' and two lower guide slits 34 and 34' longitudinally formed on the two inside walls 31 and 32 of the column 3. Two locking slits 37 and 37' are longitudinally formed on one of the two outside walls 36 of each support column 3 at upper and lower positions in the same manner as that described for the longitudinal guide slits. Two support blocks 43 and 53 are movably installed within the opening 35 of each support column 3 at upper and lower positions corresponding to the upper and lower guide slits. The upper and lower sensor units 4 and 5, each having a light receiving part 41 or 51 and a light emitting part 42 or 52 selected from infrared sensors or laser sensors, are mounted to the two support blocks 43 and 53 movably installed within the opening 35 of each support column 3. The position of the movable sensor units 4 and 5 inside each support column 3 is selectively fixed by locking bolts 38 and 38'.

The two light receiving parts 41 and 51 and two light emitting parts 42 and 52 of the upper and lower sensor units 4 and 5 installed in each support column 3 are positioned to face the two light emitting parts 42 and 52 and two light receiving parts 41 and 51 of two neighboring support columns 3. Therefore, the light emitting parts 42 and 52 of each support column 3 emit infrared rays or laser beams to the light receiving parts 41 and 51 of one neighboring support column 3, while the light receiving parts 41 and 51 of each support column 3 receive infrared rays or laser beams output from the light emitting parts 41 and 51 of the other neighboring support column 3. When part of the body of a user, such as hands, arms, feet or legs, is positioned at or passes through the paths of infrared or laser beams during an active movement of the user standing on the limited area of the pad 2, the beams are temporarily blocked. The infrared or laser beams from the light emitting parts 42 and 52 of the four columns 3 are thus intermittently intercepted by the body of the user, and so the light receiving parts 41 and 51 of the columns 3 are repeatedly and alternately activated and inactivated. Therefore, the signal units 4 and 5 of the four columns 3 output ON/OFF signals to the input port of the computer 6, such as the keyboard terminal, joystick terminal or mouse terminal of a personal computer, a commercial computer or a game machine. In response to the ON/OFF signals from the sensor units 4 and 5, the computer 6 performs the program in the same manner as that performed in accordance with input signals from a conventional keyboard, joystick or mouse operated by a user.

When the pad 2 of the present invention is designed as a foot-operable pad in the same manner as that of a conventional DDR, a user can activate or inactivate the light receiving parts 41 and 51 of the sensor units 4 and 5 of the support columns 3 with parts of his body, such as hands, arms, feet and legs, while controlling the pad by jumping activity performed by legs and feet within the limited area of the pad. In such a case, the user operates the program as if he moves in a virtual space, and so the program drive device of this invention can provide desired active physical exercise or active rhythmic movement of user's body including arms, hands, feet and legs.

In the above-mentioned preferred embodiment, the program drive device of this invention has four support columns 3 at the corners of the rectangular pad 2, and so the device only allows a user to use the program while moving in four directions, that is, forward, backward leftward and rightward directions. However, it should be understood that the number of support columns 3, each having the upper and lower sensor units 4 and 5, may be increased as desired. For example, eight support columns 3, each having the upper and lower sensor units 4 and 5 at its upper and lower portions, may be vertically installed at the four corners and the middle positions of the four sides of the pad 2. In such a case, the device preferably allows a user to use the program while moving in eight directions. In addition, sixteen support columns 3, each having the upper and lower sensor units 4 and 5, may be vertically installed on the pad 2 at predetermined positions so as to allow a user to use the program while moving in sixteen directions. Therefore, it is noted that the program drive device of this invention can allow a user to use the program while moving in four, eight or sixteen directions in accordance with the number of support columns 3.

In the present invention, it is possible to adjust the position of the support columns 3 on the control rail 1 of the pad 2 as desired. In addition, the sensor units 4 and 5 are movable along the guide slits 33, 33', 34 and 34' of each support column 3 of the pad 2, and so the height of the sensor units 4 and 5 of the support columns 3 may be adjustable as desired. Therefore, it is possible for users, regardless of height or physique, to effectively use the program drive device of this invention while adjusting the size of the motion space of the device by changing the positions of the columns 3 and the sensor units 4 and 5.

In the preferred embodiment, the control rail 1 is installed on the rectangular pad 2, with four support columns 3 having two movable sensor units 4 and 5 and vertically positioned at the corners of the pad 2 such that the position of the columns 3 on the rail 1 is adjustable as desired. However, it should be understood that the support columns 3, having two movable sensor units 4 and 5, may stand upright on a support surface in place of the pad 2 at desired positions, thus defining a desired motion space by the sensor units 4 and 5 of the columns 3. Therefore, the program drive device of this invention can be easily installed on a support surface without being limited in its installation area, and allows users to run a variety of game programs, aerobic programs or dance programs on personal computers, commercial computers, personal game machines, or commercial game machines, under the control of users' physical action, such as hand action, arm action, foot action and leg action, within a limited space.

As described above, the present invention provides a program drive device for computers. This program drive device has a plurality of sensor units movably installed in a plurality of support columns of a pad. Each of the sensor units consists of a light emitting part and a light receiving part so as to be activated or inactivated by a motion of a user's body, and outputs a motion signal to the input port of a computer, thus running a variety of game programs, aerobic programs or dance programs on personal computers, commercial computers, personal game machines, or commercial game machines, under the control of users' physical action in place of a conventional keyboard operation, joystick operation or mouse operation. The program drive device of this invention provides physical exercise and rhythmic movement of user's body while exciting user's interest. In addition, the program drive device of this invention is designed to run a game program of a computer or a game machine in response to a motion of a user's body without forcing the user to become skilled in computer operation, thus allowing people to easily and simply use game programs of computers or game machines without being afraid of complex operation procedures of the computers and game machines. This program drive device is also usable with a conventional DDR, thus running a program in response to a motion of hands, arms, feet and legs of a user. Another advantage of this program drive device resides in that it is simply and easily connected to the input port of a conventional computer, such as the keyboard terminal, joystick terminal or mouse terminal of a personal computer, commercial computer or game machine, without forcing a user to purchase a separate equipment.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A program drive device for running a game program in computers, comprising:

a pad having a predetermined area and provided with a plurality of rails thereon;

a support column movably engaging with each of said rails while standing upright on the rail, said support column being movable along the rail as desired and fixed to the rail at an adjustable position; and sensor means movably installed in each of the support columns of the rails, thus being movable along each support column and fixed to the support column at an adjustable position, whereby the sensor means senses a motion of a user's body moving on the pad and outputting a motion signal to a computer, thus allowing the computer to display a variable motion of a character, corresponding to the motion of the user's body, on a monitor of the computer.

2. The program drive device according to claim 1, wherein said sensor means is connected to a signal input port of the computer, selected from the group consisting of a keyboard terminal, a joystick terminal or a mouse terminal of a personal computer, a commercial computer, or a game machine.

3. The program drive device according to claim 1, wherein said sensor means comprises upper and lower sensor units movably installed at upper and lower portions of each support column, said upper and lower sensor units thus being movable along the support column and each consisting of a light emitting part and a light receiving part selected from the group consisting of a variety of photo sensors capable of sensing a motion of a user's body, said light emitting part and light receiving part being positioned on two inside walls of the support column, with the two inside walls of the support column meeting each other at a right angle.

4. The program drive device according to claim 1, wherein said sensor means comprises a transmissive photo sensor.

5. The program drive device according to claim 1, wherein said sensor means comprises a reflective photo sensor.

6. The program drive device according to claim 1, wherein said sensor means is adjustable in its position on the support column, thus precisely sensing a motion of a user's body regardless of height or physique of the user.

7. The program drive device according to claim 1, wherein said support column has a folding structure relative to the pad.

* * * * *